US007438569B2

(12) United States Patent
Pennypacker et al.

(10) Patent No.: US 7,438,569 B2
(45) Date of Patent: Oct. 21, 2008

(54) LOW PROFILE SOCKET CONNECTOR

(75) Inventors: Jeffrey George Pennypacker, Harrisburg, PA (US); Richard Nicholas Whyne, Camp Hill, PA (US); Daniel Robert Ringler, Elizabethville, PA (US); Attalee S. Taylor, Palmyra, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/517,667

(22) Filed: Sep. 8, 2006

(65) Prior Publication Data

US 2008/0064240 A1 Mar. 13, 2008

(51) Int. Cl.
*H01R 13/62* (2006.01)

(52) U.S. Cl. ..... 439/157

(58) Field of Classification Search ..... 439/157–160
See application file for complete search history.

(56) References Cited

U.S. PATENT DOCUMENTS 4,898,540 A * 2/1990 Saito ..... 439/153
5,676,561 A * 10/1997 Chiang ..... 439/328
5,846,095 A * 12/1998 Bowen ..... 439/157
6,039,595 A 3/2000 Tseng et al.
6,616,466 B2 9/2003 Frantum, Jr. et al.

* cited by examiner

*Primary Examiner*—Truc T Nguyen

(57) ABSTRACT

A socket connector for connecting module card to a circuit board includes a housing extending along a longitudinal axis between opposed ends. The housing includes a mounting face configured for mounting on the circuit board and a slot configured to receive a mating edge of the module card. The slot has a bottom surface that defines a seating plane for the mating edge of the module card. An extractor is pivotably connected to at least one of the opposed ends. The extractor includes a foot having a card engagement surface that is relatively higher than the bottom surface when the extractor is in a closed position.

16 Claims, 9 Drawing Sheets

LOW PROFILE SOCKET CONNECTOR

BACKGROUND OF THE INVENTION

The invention relates generally to socket connectors for retaining card edge modules and, more particularly, to a low profile connector that may be used in limited space applications.

Computers and servers may use numerous types of electronic modules, such as processor and memory modules (e.g. Dynamic Random Access Memory (DRAM), Synchronous Dynamic Random Access Memory (SDRAM), or Extended Data Out Random Access Memory (EDO RAM), and the like). The memory modules are produced in a number of formats such as, for example, Single In-line Memory Modules (SIMM's), or the newer Dual In-line Memory Modules (DIMM's), Small Outline DIMM's (SODIMM's) and Fully Buffered DIMM's. Typically, the modules are installed in one or more multi-pin sockets mounted on a system board or motherboard. Each memory module has a card edge that provides an interface generally between two rows of contacts in the socket. Conventionally, the card edge interface is a separable card edge interface.

There is an ongoing trend toward smaller electronic packages. This trend is accelerated by the adoption of certain standards such as the Advanced Telecommunications Computing Architecture (ATCA) standard. In systems that adhere to the ATCA standard, the space provided for module cards and connectors is limited. Space limitations require that the size of the electronic modules as well as connectors be reduced. As space restrictions occur, there is a corresponding concern for cooling of the modules and components that may be mounted on the modules. Thus, there is a continuing need for a low profile connector that may be used in space limited applications. In addition the connector must allow for sufficient airflow to provide adequate airflow for components on the modules mounted in the connector.

BRIEF DESCRIPTION OF THE INVENTION

In one aspect, a socket connector for connecting a module card to a circuit board. The socket connector includes a housing extending along a longitudinal axis between opposed ends. The housing includes a mounting face configured for mounting on the circuit board and a slot configured to receive a mating edge of the module card. The slot has a bottom surface that defines a seating plane for the mating edge of the module card. An extractor is pivotably connected to at least one of the opposed ends. The extractor includes a foot having a card engagement surface that is relatively higher than the bottom surface when the extractor is in a closed position.

Optionally, the extractor includes spaced-apart side walls defining an extractor slot therebetween. The extractor slot receives a non-contact edge of the module card substrate and the side walls include ribs that engage the module card substrate to stabilize the module card. The extractor foot is configured to engage a notch in the module card. The housing holds electrical contacts having an upwardly extending rear beam and a mating beam downwardly extending from the rear beam. The mating beam culminates in an end portion bent toward the rear beam and the end portion includes a contact tip configured to engage a lower portion of the housing base to preload the contact.

In another embodiment, a socket connector for connecting a module card to a circuit board is provided. The connector includes a housing extending along a longitudinal axis between opposed ends. The housing includes a mounting face configured to be mounted on the circuit board and a slot configured to receive a mating edge of the module card. An extractor is pivotably connected to at least one of the opposed ends. The extractor has a width that is less than a thickness of the module card.

In yet another embodiment, a socket connector for connecting a module card to a circuit board includes a housing extending along a longitudinal axis between opposed ends. The housing includes a mounting face configured for mounting on the circuit board and a slot configured to receive a mating edge of the module card. An extractor is pivotably connected to at least one of the opposed ends. The extractor includes a foot having an engagement surface configured to engage a notch in the module card to extract the module card.

DETAILED DESCRIPTION OF THE INVENTION

Figure 1:
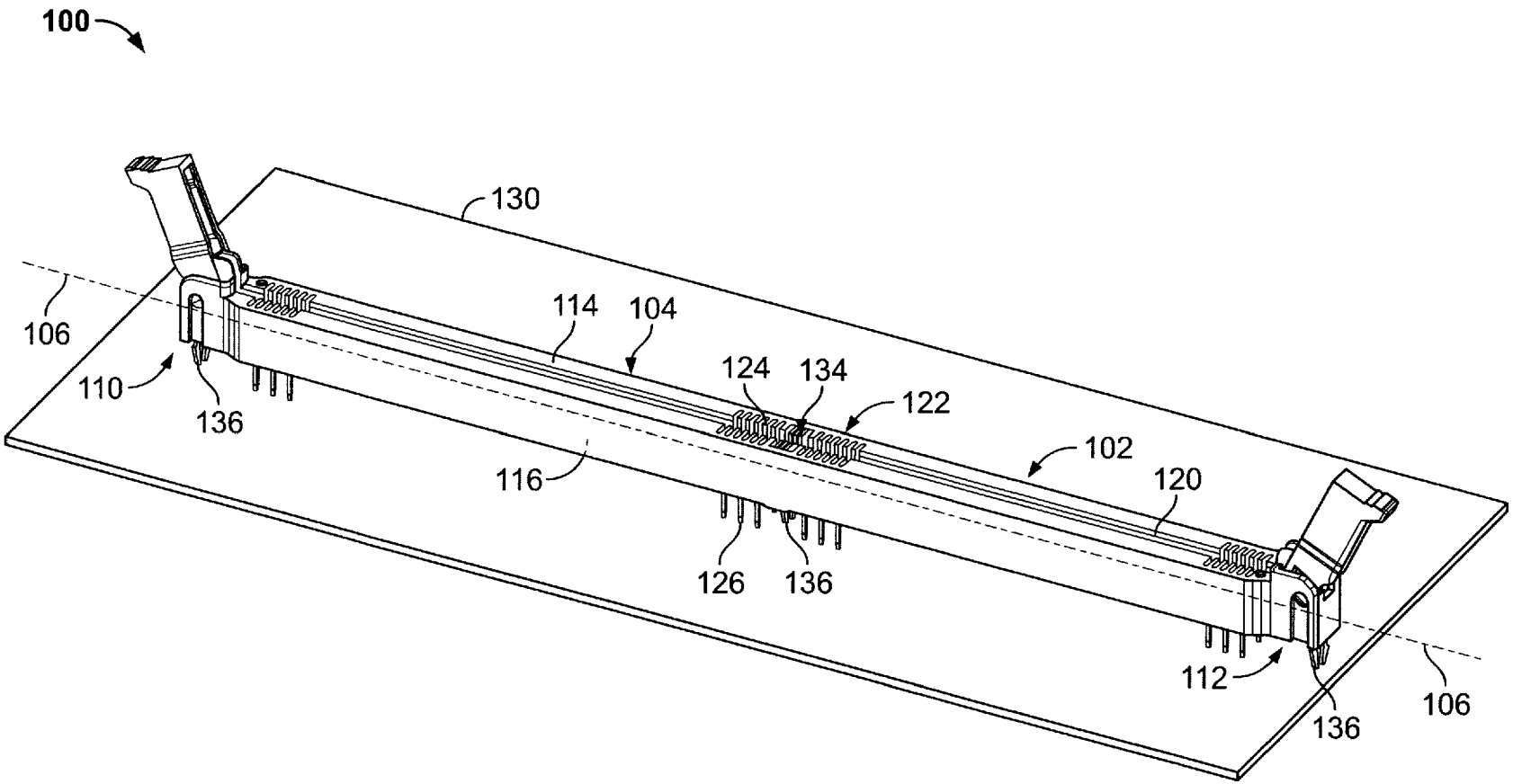
FIG. 1 is a perspective view of a socket connector formed in accordance with an exemplary embodiment of the present invention.

FIG. 1 illustrates a socket connector 100 formed in accordance with an exemplary embodiment of the present invention. The connector 100 includes a dielectric housing 102 having a base 104 that extends along a longitudinal axis 106 between opposed ends 110 and 112. The base 104 has a mating face 114 and a mounting face 116. The base 104 includes a slot 120 that is configured to receive the mating edge of a card edge electronic module or module card 140 (see FIG. 2). The housing base 104 holds electrical contacts 122 having mating ends 124 and contact tails 126. The contact mating ends 124 extend into the slot 120 to electrically engage contact pads on the electronic module 140 when the electronic module 140 is installed in the connector 100. The contact tails 126 extend from the mounting face 116 and are configured to electrically connect the connector 100 to a circuit board 130 to enable the connection of the electronic module or module card 140 to the circuit board 130. A key 134 is provided at an off-center position in the slot 114 and is received in a notch in the electronic module 140 to assure that the electronic module 140 is properly aligned with respect to the connector 100. Board locks 136 are provided to mechanically attach the connector 100 to the circuit board 130.

Figure 2:
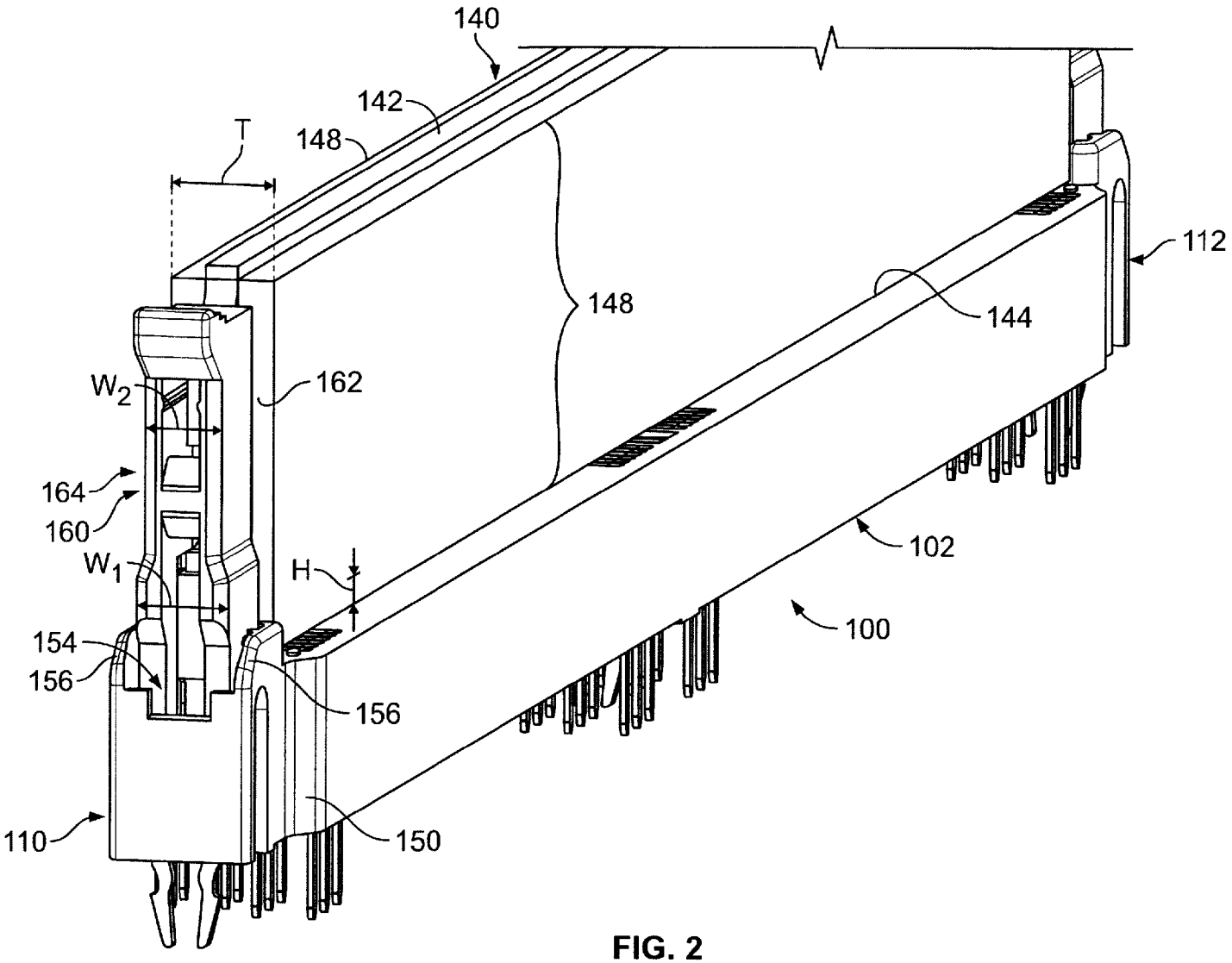
FIG. 2 is a partial perspective view of the connector shown in FIG. 1 with an electronic module installed.

FIG. 2 illustrates a partial perspective view of the connector 100 with an electronic module or module card 140 installed. The module card 140 includes a planar substrate 142 that has a mating edge 144 and a plurality of electrical traces (not shown), each of which terminates at a respective contact pad (not shown) on the mating edge 144. The substrate 142 also includes surface mounted components generally represented at 148.

Housing ends 110 and 112 are substantially identical and only housing end 110 is described in detail. Housing end 110 is connected to the housing base 104 with a tapered section 150 such that the housing end 110 is narrower than the housing base 104. The housing end 110 includes a cavity 154 between opposed sides or towers 156 that extend upwardly a distance H above the mating face 114 of the housing base 104. An extractor 160 is received in the cavity 154. The extractor 160 is pivotably connected to the housing end 110 and extends upwardly between the towers 156. The extractor 160 is pivotable between an open position to receive the module card 140 and a closed position to retain the module card 140 as shown in FIG. 2. The extractor 160 has a front side 162 that engages the module card 140 and an opposite rear side 164. The extractor 160 has a lower width $W_1$ and a lesser upper width $W_2$, both of which are less than an overall thickness or component width T of the module card 140. With the upper and lower widths $W_1$ and $W_2$ of the extractor 160 being less than the thickness T of the module card 140, the extractor 160 does not reduce air flow over the module card 140, particularly in applications where cooling air flow is directed longitudinally from the ends 110, 112 of the housing 102. The height H of the towers 156 above the mating face 114 of the housing base 104 is reduced to further facilitate cooling air flow over the module card 140. In one embodiment, the height H is approximately 1.5 millimeters. In the exemplary embodiment, the upper width $W_2$ of the extractor 160 is approximately 3 millimeters and the extractor is designed for module cards adhering to a standardized minimum thickness or component width T of 4 millimeters. Thus, the extractor does not reduce cooling air flow over the module card 140.

Figure 3:
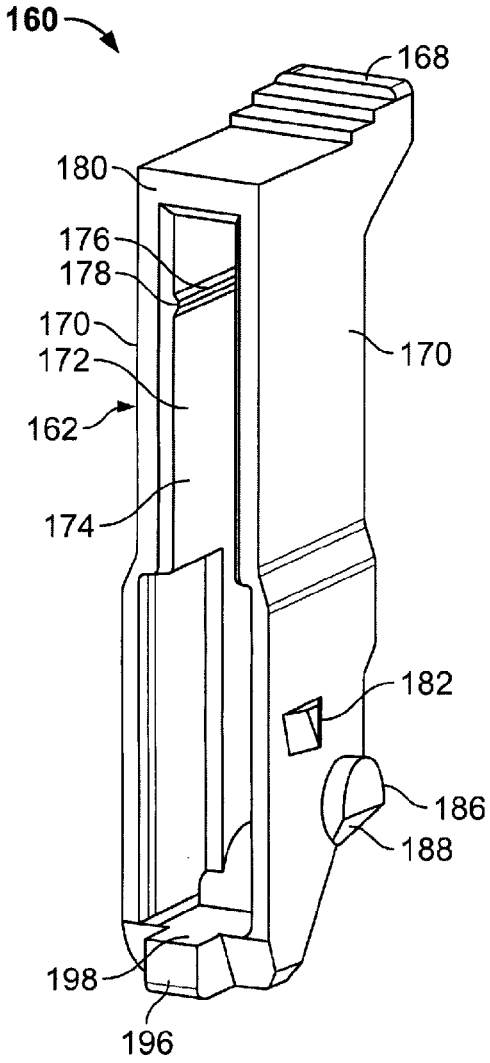
FIG. 3 is a front perspective view of the extractor shown in FIG. 2.
Figure 4:
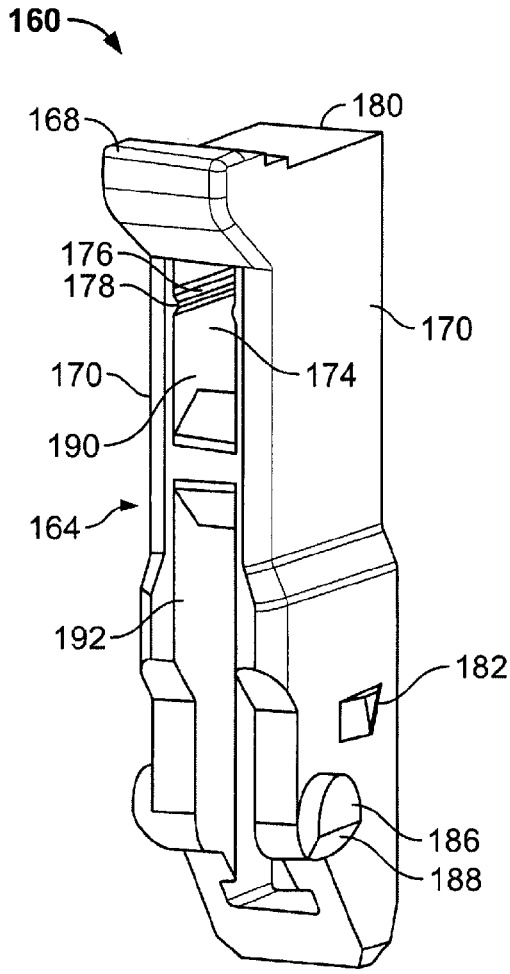
FIG. 4 is a rear perspective view of the extractor shown in FIG. 3.

FIG. 3 illustrates a perspective view of the extractor 160 taken from the front side 162. FIG. 4 illustrates a perspective view of the extractor 160 taken from the rear side 164. The extractor 160 includes a thumb pad 168 and spaced-apart side walls 170 that define an extractor slot 172 therebetween. The extractor slot 172 is in communication with the slot 120 in the housing base 104. The extractor slot 172 receives a non-contact edge of the substrate 142 (FIG. 2) of the module card 140. Interior sides 174 of the side walls 170 include ribs 176 that engage the edge of the module card 140 to stabilize the module card 140. A beveled forward edge 178 on the ribs 176 provides guidance facilitating entry of the module card edge into the extractor slot 172. A latch element 180 on the extractor 160 is configured to engage a notch in the module card 140 to retain the module card 140 in the housing 102.

A projection 182 is formed on each side 170. The projections 182 are received in retention receptacles (not shown) on inner surfaces of the towers 156 (FIG. 2) to hold the extractor 160 in the closed position. Pivot posts 186 extend from each side 170 to mount or connect the extractor 160 to the housing 102 (FIG. 1). The pivot posts 186 are substantially circular in cross section to facilitate a rotatable connection of the extractor 160 to the housing ends 110 and 112. The pivot posts 186 are provided with beveled surfaces 188 to facilitate assembly of the extractor 160 into the housing ends 110 and 112. Openings 190 and 192 extend through the extractor 160 from the rear side 164 to the extractor slot 172. The extractor 160 also includes a foot 196 having a surface 198 that engages a lower edge of the module card 140 to lift the module card 140 upward when the extractor 160 is opened to assist in the extraction of the module card 140 from the housing 102.

Figure 5:
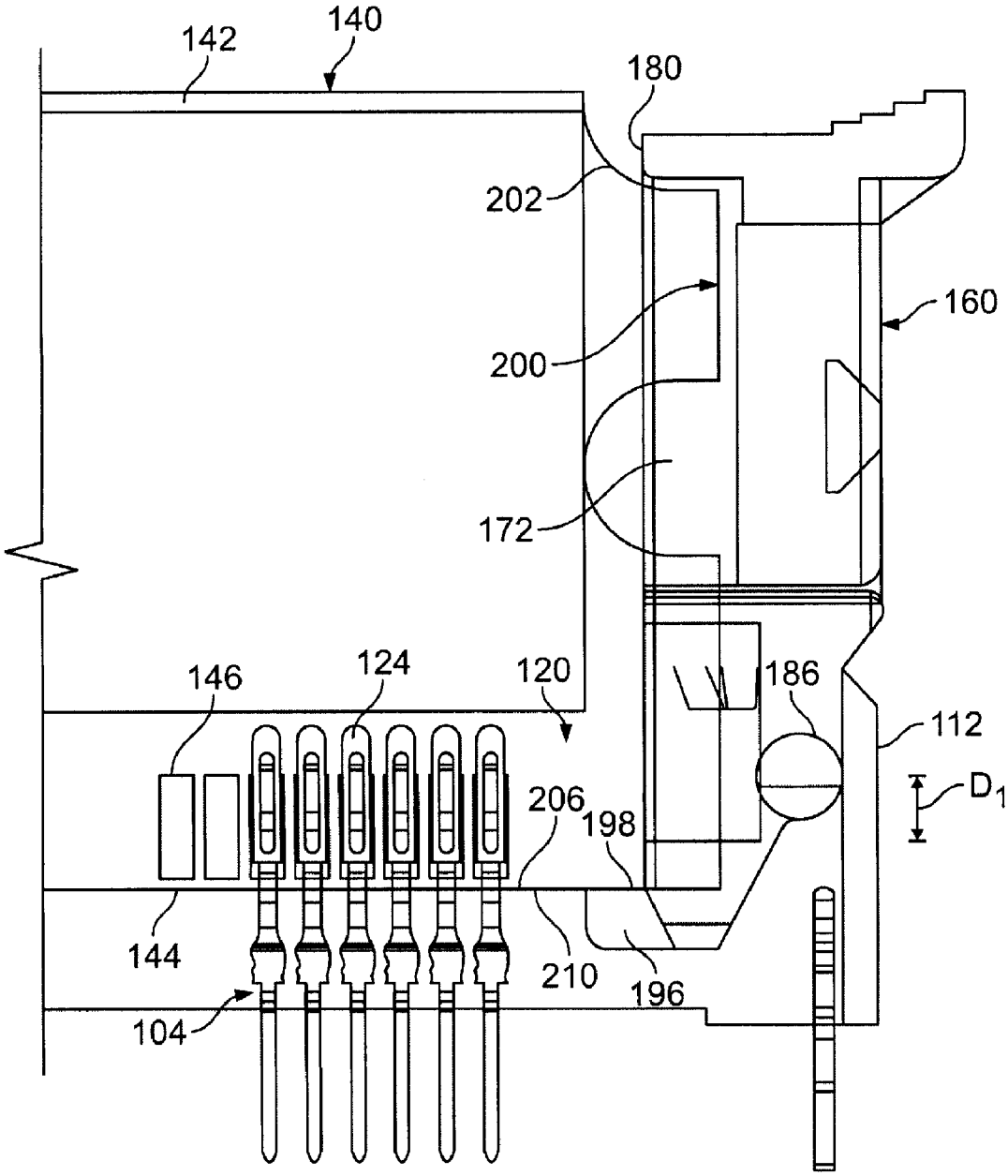
FIG. 5 is a front elevational view of a housing end with the housing partially removed to illustrate the seating of an electronic module.

FIG. 5 illustrates the housing end 112 with the housing partially removed to illustrate the seating of the module card 140. The mating edge 144 of the module card 140 is received in the slot 120 in the housing base 104. A non-contact edge 200 of the module card 140 is received in the extractor slot 172. The non-contact edge 200 includes a notch 202. The latch element 180 is received in the notch 202 to retain the module card 140 in the housing base 104 or more generally in the housing 102 (FIG. 2).

The slot 120 has a bottom surface 206 that defines a seating plane 210 through the connector housing 104. When the module card 140 is fully seated in the housing base 104, the mating edge 144 of the module card 140 abuts the bottom surface 206 of the slot 120 and lies substantially in the seating plane 210. When seated, contact pads 146 on the module card 140 electrically engage the housing contacts 124. The engagement surface 198 of the extractor foot 196 is also substantially in the seating plane 210 and engages the mating edge 144 of the module card 140. When the extractor 160 is opened, the extractor foot 196 lifts the mating edge 144 of the module card 140 out of the seating plane 210 and extracts the module card 140 from the housing base 104.

Figure 6:
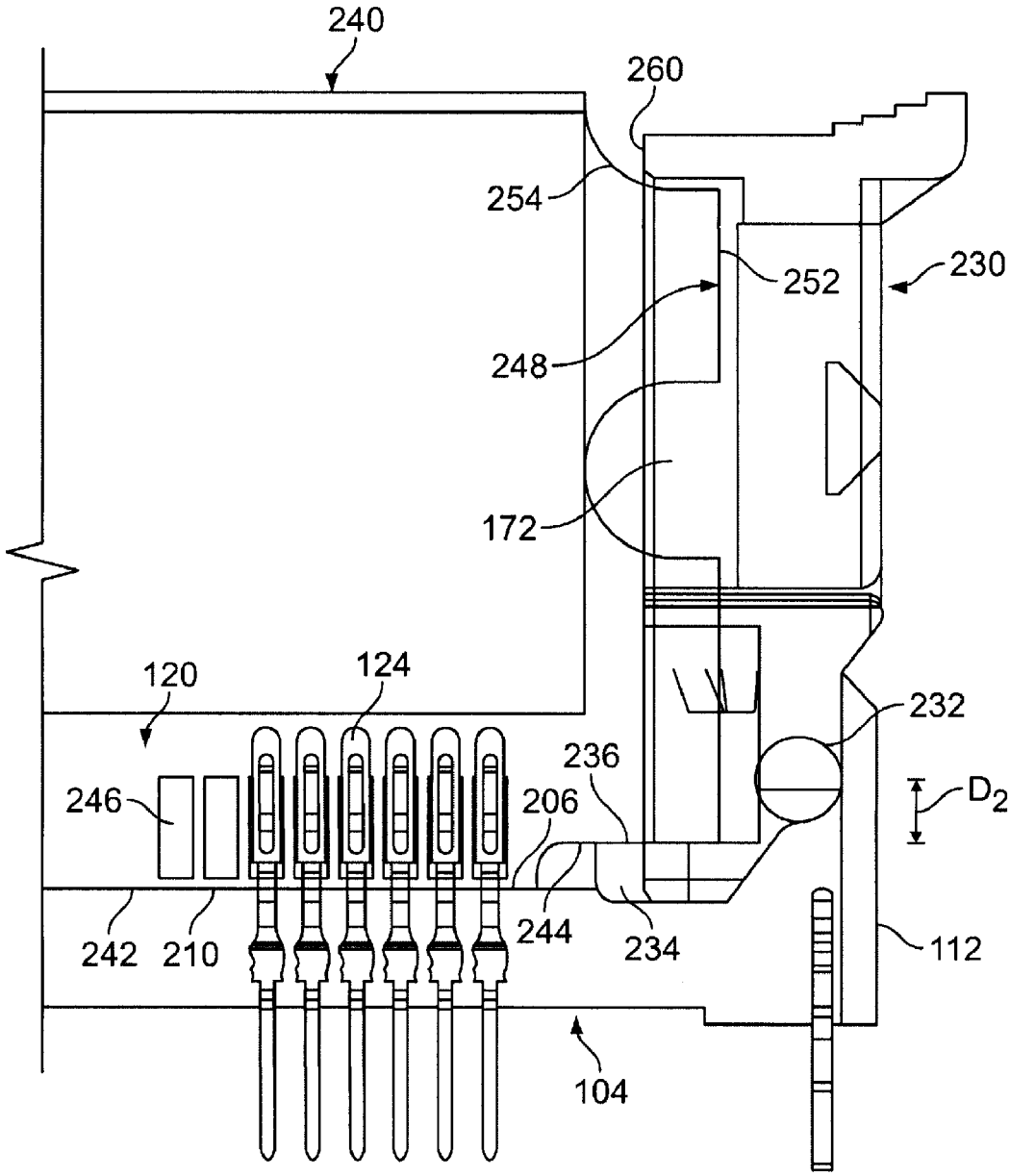
FIG. 6 is a front elevational view of a housing end with an alternative embodiment of an extractor with the housing partially removed to illustrate the seating of an alternative electronic module.

FIG. 6 illustrates the housing end 112 with an alternative embodiment of an extractor 230 formed in accordance with an alternative embodiment of the present invention. The housing 102 including the housing end 112 is partially removed to illustrate the combination of the extractor 230 with an alternative module card 240. The housing 102 including the housing end 112 are unchanged. The module card 240 is seated in the housing 102. The extractor 230 has a pivot post 232 and an extractor foot 234 that has an engagement surface 236. The extractor 230 is generally the same as the extractor 160 with the exception that the extractor foot 234 is raised. That is, the extractor foot 234 is closer vertically to the pivot post 232. As shown in FIG. 5, the engagement surface 198 of the extractor foot 196 is located at a vertical distance $D_1$ from the rotational center of the pivot post 186. With regard to the extractor 230, the engagement surface 236 of the extractor foot 234 is located at a vertical distance $D_2$ from the rotational center of the pivot post 232. The distance $D_2$ is less than the distance $D_1$. The engagement surface 236 of the extractor foot 234 is also elevated from the seating plane 210 of the housing 102. That is, the engagement surface 236 of the extractor foot 234 is relatively higher than the bottom surface 206 of the slot 120.

The extractor 230 is designed for use with module cards such as the module card 240 that includes a mating edge 242 having a notch 244 at an end thereof. The mating edge 242 of the module card 240 is received in the slot 120 in the housing base 104. A non-contact edge 248 of the module card 240 is received in an extractor slot 252. The non-contact edge 248 includes a notch 254. A latch element 260 is received in the notch 254 to retain the module card 240 in the housing base 104 or more generally in the housing 102 (FIG. 2).

The slot 120 defines a seating plane 210 as described above and the mating edge 242 of the module card 240 lies substantially in the seating plane 210 when module card 240 is fully seated in the housing base 104 with contact pads 246 on the module card 240 electrically engaging the housing contacts 124. When the extractor 230 is opened, the extractor foot 234 engages the notch 244 to extract the module card 240 from the housing base 104.

Figure 7:
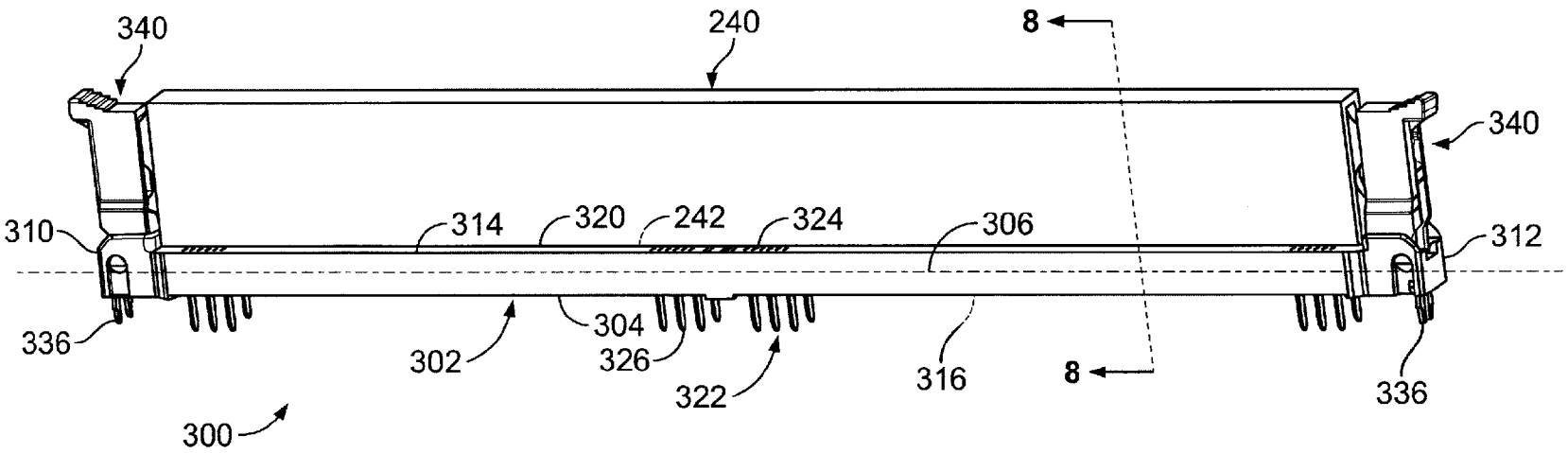
FIG. 7 is a perspective view of an electronic module installed in a socket connector formed in accordance with an alternative embodiment of the present invention.

FIG. 7 illustrates a connector 300 formed in accordance with an alternative embodiment of the present invention. The connector 300 is suitable for use with the module card 240 including the notch 244 formed at the mating edge 242 as shown in FIG. 6. The connector 300 includes a dielectric housing 302 having a base 304 that extends along a longitudinal axis 306 between opposed ends 310 and 312. The base 304 has a mating face 314 and a mounting face 316. The base 304 includes a slot 320 that is configured to receive the mating edge 242 of a module card 240. The housing base 304 holds electrical contacts 322 having mating ends 324 and contact tails 326. The contact mating ends 324 extend into the slot 320 to electrically engage contact pads 246 (FIG. 6) on the electronic module 240 when the electronic module 240 is installed in the connector 300. The contact tails 326 extend from the mounting face 316 and are configured to electrically connect the connector 300 to a circuit board (not shown in FIG. 7) to enable the connection of the module card 240 to the circuit board. A key (not shown) is provided at an off-center position in the slot 320 and is received in a notch (not shown) in the electronic module 240 to assure that the electronic module 240 is properly aligned with respect to the connector 300. Board locks 336 are provided to mechanically attach the connector 300 to the circuit board. Each of the housing ends 310 and 312 includes an extractor 340 that is identical to the extractor 230 shown in FIG. 6 and described above.

Figure 8:
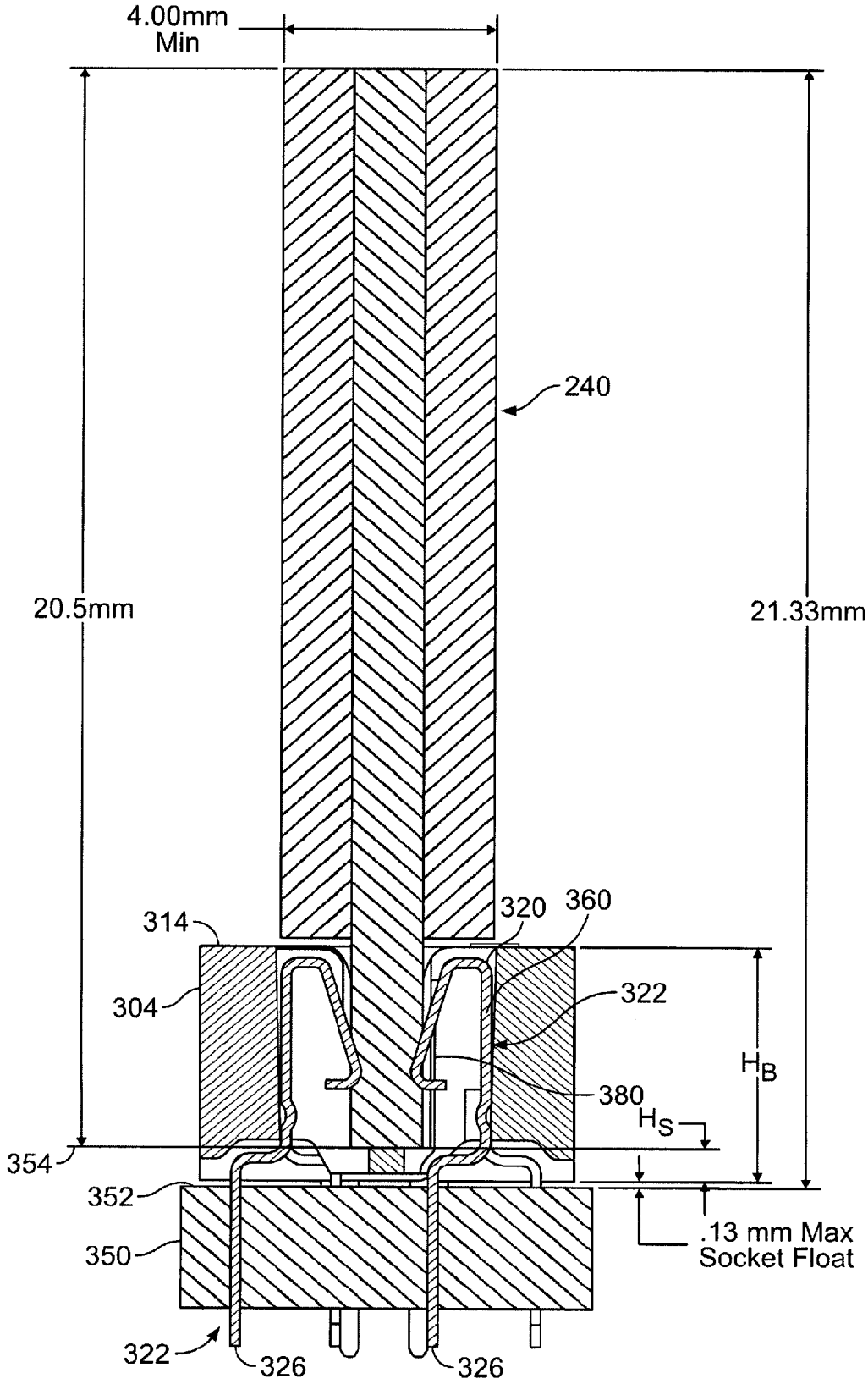
FIG. 8 is a cross-sectional view of the connector and electronic module shown in FIG. 7 taken along the line 8-8.

FIG. 8 illustrates a cross-sectional view of the connector 300 and the electronic module 240 with the connector 300 mounted on a circuit board 350. The circuit board 350 has an upper or mounting surface 352. In the connector 300, the housing base 304 is designed with a reduced height $H_B$ so that the connector 300 is suitable for limited space applications. The housing base 304 has a seating plane height $H_S$ measured from a seating plane 354 to the upper surface 352 of the circuit board 350. In one embodiment, the height $H_B$ of the housing base 304 is 4.5 millimeters and the seating plane height $H_S$ is 0.7 millimeters with a maximum socket float of 0.13 millimeters. With a module card 240 having a maximum height of 20.5 millimeters, the overall height of the socket connector and module card assembly as shown is 21.33 millimeters which meets the standard for an Advanced Telecommunications Computing Architecture (ATCA) compliant front board. The contacts 322 are compatible with the housing base 304 as described below.

Figure 9:
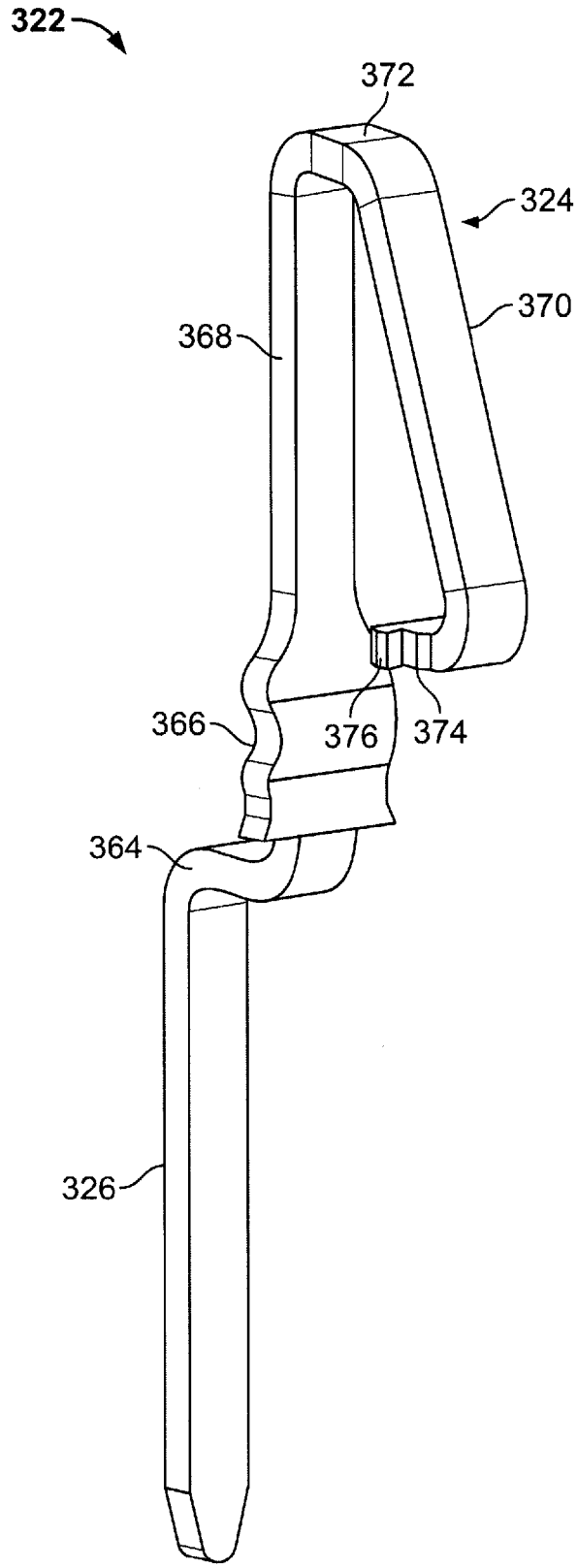
FIG. 9 is a perspective view of a contact shown in FIG. 8.

FIG. 9 is a perspective view of the contact 322. The contact 322 includes the contact tail 326 and an offset section 364. The contact 322 may have either an inward offset or the outward offset shown. The housing base 304 (FIG. 8) may include both varieties. A mounting section 366 is provided for mounting the contact 322 in the housing base 304. A rear beam 368 extends upwardly from the mounting section 366. The mating end 324 includes a mating beam 370 that downwardly extends from an upper bend 372 between the rear beam 368 and the mating beam 370. The mating beam 370 culminates in an end portion 374 that is bent toward the rear beam 368. The end portion 374 includes a contact tip 376 that is configured to engage an inner surface 380 (FIG. 8) of the housing base 304 to apply a preload to the contact 322. The combined lengths of the rear beam 368 and the mating beam 370 render the contact 322 sufficiently compliant for use on the connector 300. The bent geometry of the beams 368 and 370 enables the contact 322 to fit within the envelope of the housing base 304.

Figure 10:
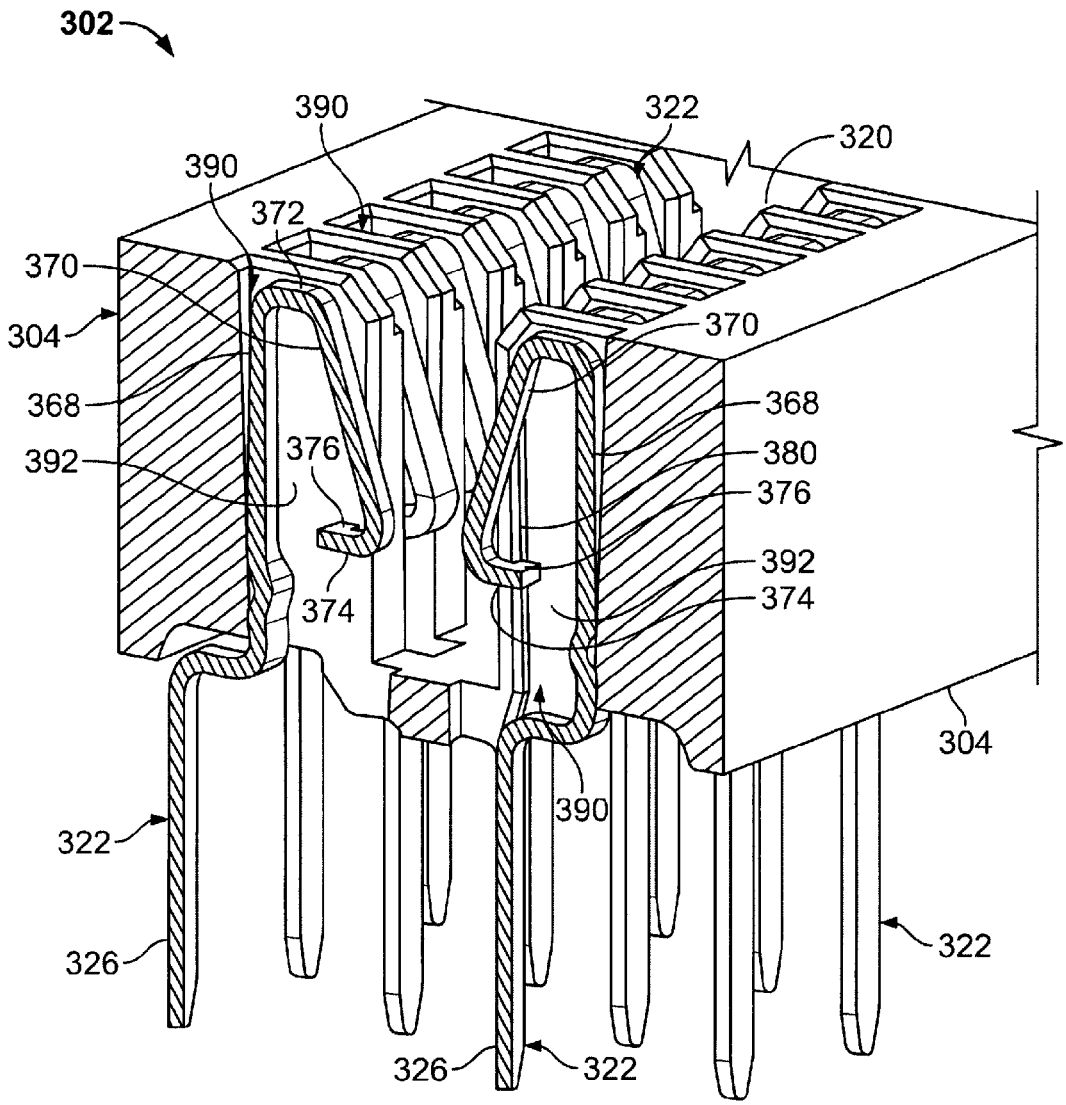
FIG. 10 is an enlarged fragmentary cross sectional veiw of the connector 300 shown in FIG. 8.

FIG. 10 illustrates an enlarged fragmentary cross-sectional view of the connector housing 302. As in FIG. 8, the cross section is taken through a contact channel 390 in the connector housing base 304, with the module card 240 and the circuit board 350 omitted. Contacts 322 are loaded into the connector housing base 304. The mating beam 370 of the contact 322 extends at least partially into the slot 320 in the housing 302. As previously described, the contact 322 includes an end portion 374 having a contact tip 376 that is configured to engage an inner surface 380 of the housing base 304 to apply a preload to the contact 322. In the illustrated embodiment, the inner surface 380 comprises a ledge or protrusion formed on an inner wall 392 of the contact channel 390 in the connector housing base 304.

The embodiments thus described provide a low profile socket connector suitable for use in limited space applications. The connector meets ATCA height restrictions and does not obstruct cooling air flow to the components on the module cards. The connector is designed with a lower seating plane to accommodate the ATCA height restrictions as well as other low profile applications. The extractors have a thin profile for increased air flow to the module card. Additionally, the towers at the ends of the housing are lower and thinner for improved air flow. The connector includes a contact designed for the low profile housing. The connector may be used with memory modules and other in-line card type modules all of which are encompassed within the term module as used herein.

While the invention has been described in terms of various specific embodiments, those skilled in the art will recognize that the invention can be practiced with modification within the spirit and scope of the claims. FIG. 10 illustrates an enlarged fragmentary cross-sectional view of the connector housing 302. As in FIG. 8, the cross section is taken through a contact channel 390 in the connector housing base 304, with the module card 240 and the circuit board 350 omitted. Contacts 322 are loaded into the connector housing base 304. The mating beam 370 of the contact 322 extends at least partially into the slot 320 in the housing 302. As previously described, the contact 322 includes an end portion 374 having a contact tip 376 that is configured to engage an inner surface 380 of the housing base 304 to apply a preload to the contact 322. In the illustrated embodiment, the inner surface 380 comprises a ledge or protrusion formed on an inner wall 392 of the contact channel 390 in the connector housing base 304.

What is claimed is:

1. A socket connector for connecting a module card to a circuit board, said socket connector comprising:

a housing extending along a longitudinal axis between opposed ends, the housing including a mounting face configured for mounting on the circuit board and a slot configured to receive a mating edge of the module card, said slot having a bottom surface defining a seating plane for the mating edge of the module card;

electrical contacts held in said housing, each said contact having an upwardly extending rear beam and a mating beam downwardly extending from said rear beam, said mating beam culminating in an end portion bent toward said rear beam, said end portion including a contact tip configured to engage a protrusion formed on an inner wall of said housing base to preload said contact; and an extractor pivotably connected to at least one of said opposed ends and pivotable between an open position and a closed position, said extractor including a foot having a card engagement surface that is located relatively higher than the bottom surface when the extractor is in the closed position, and wherein said engagement surface engages the module card to lift the module card out of said seating plane when said extractor is moved to the open position.

2. The socket connector of claim 1, wherein the module card includes a substantially planar substrate and said extractor includes spaced-apart side walls defining an extractor slot therebetween, said extractor slot receiving a non-contact edge of the module card substrate, and wherein said side walls include ribs that engage the module card substrate to stabilize the module card.

3. The socket connector of claim 1, wherein said extractor foot is configured to engage a notch in the module card.

4. The socket connector of claim 1, wherein said seating plane is about 0.7 millimeters above the circuit board.

5. The socket connector of claim 1, wherein said extractor has an exterior width less than 4 millimeters.

6. A socket connector for connecting a module card to a circuit board, said socket connector comprising:

a housing extending along a longitudinal axis between opposed ends, the housing including a mounting face configured for mounting on the circuit board and a slot configured to receive a mating edge of the module card; and an extractor pivotably connected to at least one of said opposed ends, said extractor having an exterior width that is less than a thickness of the module card, the exterior width spanning a pair of spaced-apart side walls and an extractor slot between the side walls.

7. The socket connector of claim 6 wherein said slot includes a bottom surface that defines a seating plane for the mating edge of the module card and said extractor includes a foot having a card engagement surface is above said seating plane.

8. A socket connector for connecting a module card to a circuit board, said socket connector comprising:

a housing extending along a longitudinal axis between opposed ends, the housing including a mounting face configured for mounting on the circuit board and a slot configured to receive a mating edge of the module card;

an extractor pivotably connected to at least one of said opposed ends, said extractor having an exterior width that is less than a thickness of the module card; and electrical contacts held in said housing, each said contact having an upwardly extending rear beam and a mating beam downwardly extending from said rear beam, said mating beam culminating in an end portion bent toward said rear beam, said end portion including a contact tip configured to engage a protrusion on an inner wall of said housing base to preload said contact.

9. The socket connector of claim 6, wherein the module card includes a substantially planar substrate, said spaced-apart side walls defining said extractor slot therebetween, said extractor slot receiving a non-contact edge of the module card substrate, and wherein said side walls include ribs that engage the module card substrate to stabilize the module card.

10. The socket connector of claim 6, wherein said exterior width is less than 4 millimeters.

11. A socket connector for connecting a module card on a circuit board, said socket connector comprising:

a housing extending along a longitudinal axis between opposed ends, the housing including a mounting face configured for mounting on the circuit board and a slot configured to receive a mating edge of the module card;

electrical contacts held in said housing, each said contact having an upwardly extending rear beam and a mating beam downwardly extending from said rear beam, said mating beam culminating in an end portion bent toward said rear beam, said end portion including a contact tip configured to engage a protrusion formed on an inner wall of said housing base to preload said contact; and an extractor pivotably connected to at least one of said opposed ends, said extractor including a foot having an engagement surface configured to engage a notch in the module card to extract the module card.

12. The socket connector of claim 11 wherein said slot includes a bottom surface that defines a seating plane for the mating edge of the module card and said engagement surface of said extractor foot is above said seating plane.

13. The socket connector of claim 11, wherein the module card includes a substantially planar substrate and said extractor includes spaced-apart side walls defining an extractor slot therebetween, said extractor slot receiving a non-contact edge of the module card substrate, and wherein said side walls include ribs that engage the module card substrate to stabilize the module card.

14. The socket connector of claim 11, wherein said extractor has an exterior width that is less than a thickness of the module card.

15. The socket connector of claim 11, wherein said extractor has an exterior width less than 4 millimeters.

16. The socket connector of claim 11 wherein said slot includes a bottom surface that defines a seating plane for the mating edge of the module card and said seating plane is about 0.7 millimeters above the circuit board.

* * * * *